US006511071B1

(12) United States Patent
Artle et al.

(10) Patent No.: US 6,511,071 B1
(45) Date of Patent: Jan. 28, 2003

(54) METHOD OF PLAYING SUPER PAN 9

(76) Inventors: Tom Artle, 267 W. H St., Benicia, CA (US) 94510; Frank Salerno, 53 Marina Lakes Dr., Richmond, CA (US) 94804

( * ) Notice: Subject to any disclaimer, the term of this patent is extended or adjusted under 35 U.S.C. 154(b) by 0 days.

(21) Appl. No.: 09/858,259

(22) Filed: May 15, 2001

Related U.S. Application Data

(60) Provisional application No. 60/204,286, filed on May 15, 2000.

(51) Int. Cl.[7] ..... A63F 1/00

(52) U.S. Cl. ..... 273/292; 273/274; 273/309; 463/13; 463/12

(58) Field of Search ..... 273/292, 146, 273/274, 309; 463/14, 13, 12

(56) References Cited

U.S. PATENT DOCUMENTS

| | | | | | |
|---|---|---|---|---|---|
| 5,226,661 | A | * | 7/1993 | Wolf | 273/274 |
| 5,249,809 | A | * | 10/1993 | Wolf | 273/274 |
| 5,362,064 | A | | 11/1994 | Lofink et al. | |
| 5,395,119 | A | | 3/1995 | Jacob et al. | |
| 5,397,128 | A | * | 3/1995 | Hesse et al. | 273/274 |
| 5,503,401 | A | | 4/1996 | Nguyen | |
| 5,529,309 | A | | 6/1996 | Bartlett | |
| 5,605,333 | A | * | 2/1997 | Field | 273/274 |
| 5,653,445 | A | | 8/1997 | Quach | |
| 5,690,335 | A | * | 11/1997 | Skratulia | 273/146 |
| 5,702,104 | A | | 12/1997 | Malek et al. | |
| 5,720,483 | A | | 2/1998 | Trinh | |
| 5,725,215 | A | * | 3/1998 | Hesse | 273/274 |
| 5,806,854 | A | | 9/1998 | Coleman | |
| 5,810,360 | A | | 9/1998 | Srichayaporn | |
| 5,848,790 | A | * | 12/1998 | Huynh | 273/292 |
| 5,857,678 | A | | 1/1999 | Coleman | |
| 5,873,572 | A | * | 2/1999 | Huynh | 273/292 |
| 5,951,011 | A | * | 9/1999 | Potter et al. | 273/292 |
| 6,325,375 | B1 | * | 12/2001 | Potter et al. | 273/292 |

* cited by examiner

*Primary Examiner*—Benjamin H. Layno
*Assistant Examiner*—Dolores R Collins
(74) *Attorney, Agent, or Firm*—Douglas E. White

(57) ABSTRACT

A rule change for Super Pan 9 presents a slight edge to the banker, thus encouraging greater participation in the game by those who ordinarily do not wish to bank and by those who desire to have their bets covered by a fully funded banker. A method of play comprises the specific designation of a type or value of special-rule Super Pan 9 hand (banker player's or non-banker player's), the appearance of which causes the banker to win a specified percentage of either all bets (when a banker's hand is designated) or of the bet of the non-banker player having the hand (when a non-banker player's hand is designated). The increase in odds favoring the banker is held to a predetermined and acceptably low value by the choice of special-rule hand whose frequency of occurrence can be determined statistically.

9 Claims, 4 Drawing Sheets

BANKER

PLAYER 1

PLAYER 2

PLAYER 3

BANKER PLAYER 1

BANKER

PLAYER 1

PLAYER 2

METHOD OF PLAYING SUPER PAN 9

CROSS REFERENCE TO RELATED APPLICATIONS

This application claims the benefit of U.S. Provisional Application No. 60/204,286, filed May 15, 2000.

FEDERALLY SPONSORED RESEARCH OR DEVELOPMENT

Not applicable.

1. Field of the Invention

This invention relates to card games, more particularly to an improved method of playing the card game known as Super Pan 9 (which is itself a version of a game called Pan 9).

2. Background of the Invention

Super Pan 9 is a card game often enjoyed in legalized gambling establishments. Super Pan 9 is quite similar in play and rules to Baccarat (a variation of which is called Chemin de Fer).

The prior art rules of Super Pan 9 are as follows. Standard poker decks of 52 cards are employed, except that all Sevens, Eights, Nines and Tens are removed. Normally, eight decks are compiled and used together, for a total of 288 cards. The object of the game is to obtain a higher-ranking hand than the player who is also functioning as the banker. The player/banker is also known as the designated player, but hereinafter often simply will be referred to as the "banker." The highest hand has a score of 9 and the lowest hand a score of 0. The game is played modulo ten: that is, if the total value sum of a hand exceeds ten, then 10 is subtracted from the total. In other words, when the total is 10 or more, only the right-hand digit counts. Normally, the banker must stand on 7 or better and hit on 3 or less. A typical "house way" rule employed in certain situations is that a player must stand on 6 or better and hit on 5 or less.

The game is dealt to 7 or 8 players (positions) on a poker-style table. Normally, a house dealer controls the shuffling and dealing of the cards and the house collections for each hand. One of the players is designated the player/banker for that hand. Typically, each player may bank twice, but also may decline entirely to accept the "banker button" which designates the banker. All players play their hand against the banker's hand only.

A dice cup is shaken to determine which seated player position receives an "action button" denoting which hand is to be first when the play begins. The house dealer deals each player three cards, one at a time, starting at the action button. The banker's cards are placed in front of the dealer and kept face down. The players may stand on their hands or draw one additional card. When the draw is concluded, the dealer turns the banker's cards over. The banker may stand or draw according to the above rules governing the banker's draw. The card values are Face Cards=0; Aces=1; and all other Cards=face value.

In the typical prior art game of Super Pan Nine, settlement proceeds as follows, provided the banker has bet enough to settle all bets: players having a higher score than the banker are paid the amount of their bet by the banker; players having a lower score than the banker pay the banker; and players that tie the banker "push." A push between a player and the banker means that both sides (banker and that particular player) get back their bets against each other.

As played in the prior art, there is no real advantage to being the banker, because there are no hands favoring the banker. Therefore, many hands are played wherein not all bets are covered by the player/banker. This disappoints players who are dealt a good hand that is not covered by the banker. The game would enjoy higher popularity were bankers, especially professional bankers, to have an incentive to bank therein because they then would almost always cover all bets.

Prior developments in this field may be generally illustrated by reference to the following information disclosure statement:

| U.S. Patent Documents | | |
|---|---|---|
| U.S Pat. No. | Patentee | Issue Date |
| 5.503,401 | S. Nguyen | Apr. 2, 1996 |
| 5,690,335 | J. Skratulia | Nov. 25, 1997 |
| 5,720,483 | H. Trinh | Feb. 24, 1998 |
| 5,857,678 | R. Coleman | Jan. 12, 1999 |
| 5,806,854 | R. Coleman | Sep. 15, 1998 |
| 5,702,104 | M. Malek et al. | Dec. 30, 1997 |
| 5,529,309 | L. Bartlett | Jun. 25, 1996 |
| 5,395,119 | D. Jacob et al. | Mar. 7, 1995 |
| 5,362,064 | R. Lofink et al. | Nov. 8, 1994 |
| 5,653,445 | H. Quach | Aug. 5, 1997 |
| 5,397,128 | M. Hesse et al. | Mar. 14, 1995 |
| 5,810,360 | S. Srichayaporn | Sep. 22, 1998 |

U.S. Pat. No. 5,397,128 is described as a hybrid of blackjack and baccarat "similar enough" to Pan 9 (at least in learnability; col. 9, lines 47–50) that uses a player/banker and is designed to give a small advantage to the banker (col. 5, lines 20–25). The player/banker is given the small advantage by adjusting the number of nines in the deck and by the selection of a banker's winning hand of predetermined value, namely: if the banker has a natural nine (no hit was made), this beats anything except another natural nine. Surrender, double and jackpot options are taught. Other rule variations, besides including nines, make this game a departure from Super Pan 9.

U.S. Pat. No. 5,362,064 is art from a baccarat perspective. There is no player/banker. The dealer's (house banker's) mathematical advantage is assured by preselecting one or more hand combinations as "barred," wherein a normally winning hand becomes a push hand during pay off. The bar hand combinations are preselected according to their statistical likelihood of being dealt. A number of varieties are suggested, including pairs, three of a kind, and three card flushes. Varieties using combinations of player and bank hand totals also are shown. At col. 18, lines 42–50, side bets are taught wherein such preselected hands as triplets or three card flushes determine the winner.

U.S. Pat. Nos. 5,503,401, 5,690,335 and 5,720,483 teach card games dealing with the banking method of play. In U.S. Pat. No. 5,503,401, there are no rules favoring the banker. In U.S. Pat. No. 5,720,483 a method of play which eliminates banking is taught. In U.S. Pat. No. 5,690,335, a variation of Super Pan 9 or Pan 9 is taught wherein the banker is favored by winning ties.

U.S. Pat. Nos. 5,806,854, 5,857,678 and 5,701,104 teach modified baccarat card games.

U.S. Pat. No. 5,529,309 teaches a baccarat type game where the dealer's (house banker's) mathematical advantage is gained by manipulating the card draw rules. No player/banker is used.

U.S. Pat. No. 5,395,119 teaches a surrender option in baccarat. U.S. Pat. No. 5,810,360 teaches the concept of the players playing against each other rather than against a bank.

The rest of the patents are representative of what was found in a search of the art.

It therefore will be appreciated that there continues to be a need for a new and improved method of playing Super Pan 9 which addresses the problems of banking, risk allocation and ease of play that are attendant in the prior art. In this respect, the present invention substantially fulfills this need.

SUMMARY OF THE INVENTION

In view of the disadvantages inherent in the known art, the general purpose of the present invention, which will be described subsequently in greater detail, is to teach a new and improved method of playing Super Pan 9 which has all of the important advantages of the prior art and few, if any, of the disadvantages.

The present invention comprises rule changes for Super Pan 9 which present a slight, but equitable, edge to the banker, thus encouraging greater participation in the game by those who do not wish to bank and by those who desire to have their bets covered by a fully funded banker.

What all embodiments of the invention have in common is the specific designation of a type or value of "special-rule" Super Pan 9 hand (banker's or player's), the appearance of which causes the banker to win a specified percentage of either all bets (when a banker hand is designated) or of the bet of the player having the hand (when a player hand is designated or matching player/banker hands are designated). The increase in odds favoring the banker is held to a predetermined and acceptably low value by the choice of special-rule hands whose frequency of occurrence can be determined statistically.

FEATURES AND ADVANTAGES

It is therefore an object of the present invention to provide a new and improved method of playing Super Pan 9 which has all, or nearly all, of the advantages of the prior art, while simultaneously overcoming most of the disadvantages normally associated therewith.

It is another object of the present invention to provide a new and improved method of playing Super Pan 9, which may be easily and efficiently learned and played.

A further object or feature of the present invention is a new and improved method of playing Super Pan 9 that permits improved banking opportunities.

Another object or feature is a new and improved method of playing Super Pan 9 that is easy to play and to calculate the odds of winning.

Accordingly, a feature of this invention is a method of playing Super Pan 9, including the steps of: providing a deck of playing cards, said card deck having a like number of aces, twos, threes, fours, fives, sixes, jacks, queens and kings, said jacks, queens and kings being denominated face cards; providing a banker player and a non-banker player; said non-banker player and said banker player placing a non-banker player's bet and a banker player's bet, respectively; dealing from said deck a banker player's initial hand of three cards to said banker player and a non-banker player's initial hand of three cards to said non-banker player; providing each player with the opportunity to select between drawing an additional card and standing on said player's initial hand; evaluating players' hands of dealt cards according to the sum of the values of said dealt cards, modulo ten, the value of twos, threes, fours, fives and sixes being their face value, the value of aces being one, and the value of jacks, queens and kings being zero; and providing that a non-banker player wins from or loses to said banker player a preselected specified percentage of said non-banker player's bet when one of said players' initial hands is comprised of cards chosen according to a preselected special-rule for determining said preselected specified percentage.

Another feature is such a method wherein there is one said banker player and there is a plurality of said non-banker players.

Yet another feature is wherein said preselected special-rule is that when said banker player's initial hand evaluates to zero, said banker player must stand on said banker player's initial hand and said non-banker player wins from said banker player 100 percent of said non-banker player's bet when said non-banker player's hand evaluates to 7, 8 or 9, said non-banker player wins from said banker player 50 percent of said non-banker player's bet when said non-banker player's hand evaluates to 6, and said non-banker player wins from said banker player zero percent of said non-banker player's bet when said non-banker player's hand evaluates to 5 or less.

An alternate feature is wherein said preselected special-rule is that when said non-banker player's initial hand is comprised of all face cards, said non-banker player loses to said banker player 100% of said non-banker player's bet.

Another alternate feature is wherein said preselected special-rule is that when said banker player's initial hand is comprised of all face cards, said non-banker player loses to said banker player 50 percent of said non-banker player's bet.

Yet another alternate feature is wherein said preselected special-rule is that when said banker player's initial hand is comprised of all face cards, and said banker player draws a face card, said non-banker player loses to said banker player 100% of said non-banker player's bet.

Still another feature is a method of playing Super Pan 9, including the steps of: providing a deck of playing cards, said card deck having solely a like number of aces, twos, threes, fours, fives, sixes, jacks, queens and kings, said jacks, queens and kings being denominated face cards; providing a banker player and a non-banker player; said non-banker player and said banker player placing a non-banker player's bet and a banker player's bet, respectively; dealing from said deck a banker player's initial hand of three cards to said banker player and a non-banker player's initial hand of three cards to said non-banker player; providing each player with the opportunity to select between drawing an additional card and standing on said player's initial hand, said selection resulting in said player's final hand; evaluating players' hands of dealt cards according to the sum of the values of said dealt cards, modulo ten, the value of twos, threes, fours, fives and sixes being their face value, the value of aces being one, and the value of jacks, queens and kings being zero; and providing that when said banker player's initial hand evaluates to zero, said banker player must stand on said banker player's initial hand and said non-banker player wins from said banker player 100 percent of said non-banker player's bet when said non-banker player's final hand evaluates to 7, 8 or 9, said non-banker player wins from said banker player 50 percent of said non-banker player's bet when said non-banker player's final hand evaluates to 6, and said non-banker player wins from said banker player zero percent of said non-banker player's bet when said non-banker player's hand evaluates to 5 or less.

A further feature is such a method further including the steps of: providing that said banker player must draw an additional card when said banker player's initial hand evaluates to 1, 2, or 3; providing that said banker player may select between drawing an additional card and standing on said banker player's initial hand when said banker player's initial hand evaluates to 4, 5, 6, 7, or 8; and providing that said banker player must stand on said banker player's initial hand when said banker player's initial hand evaluates to 9.

Yet a further feature is such a method including the step of providing, when said banker player's initial hand does not evaluate to zero, that said non-banker player wins from said banker player 100 percent of said non-banker player's bet when said non-banker player's final hand evaluates to a higher number than does said banker player's final hand, that said non-banker player wins from said banker player zero percent of said non-banker player's bet when said non-banker player's final hand evaluates to the same number as does said banker player's final hand, and that said non-banker player loses to said banker player 100 percent of said non-banker player's bet when said non-banker player's final hand evaluates to a lower number than does said banker player's final hand.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty, which characterize the invention, are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trade-mark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWING

The invention will be better understood and objects other than those set forth above will become apparent when consideration is given to the following detailed description thereof. Such description makes reference to the annexed drawing wherein.

DETAILED DESCRIPTION OF THE INVENTION

Figure 1:
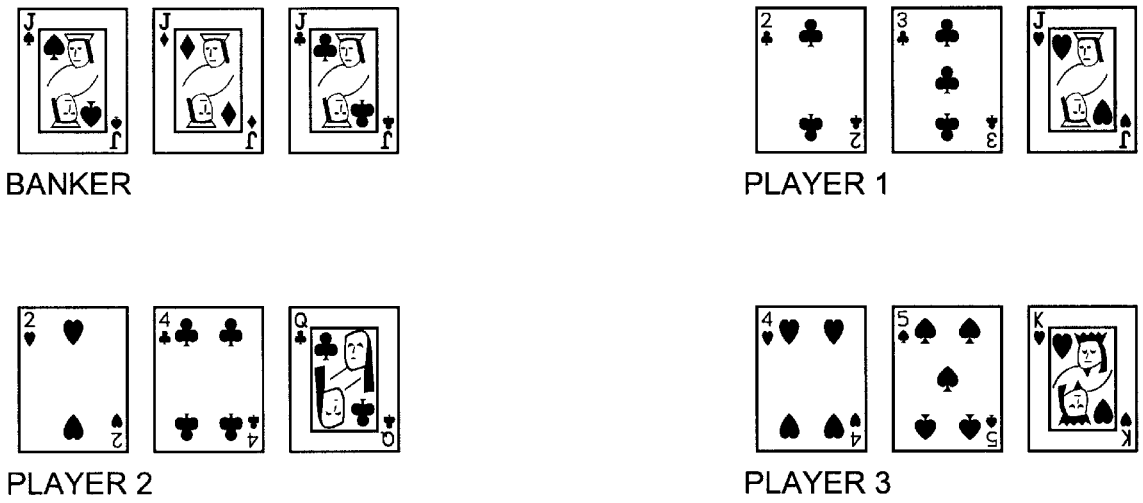
FIG. 1 is a schematic top view of a card round illustrating a first preferred method of playing Super Pan 9 of this invention.

Referring to FIGS. 1–4, there is illustrated therein a first new and improved method of playing Super Pan 9 of this invention. The object is for a player to get as close to 9 as possible by adding the value of his or her cards. When the total is 10 or more, only the right-hand digit of the total counts. Face Cards count 0, Aces 1, and all other cards count their face value. As in the prior art, the deck preferably has 288 cards, comprising eight poker decks with all Sevens, Eights, Nines and Tens removed. As few as six modified poker decks may be used in the preferred embodiment. While the game might be played with fewer than six or more than eight modified poker decks, this is currently not preferred.

In turn, each seated player has the option to be the designated player or banker for two consecutive hands, provided there was a bet on the previous hand. For each hand, the position of the action button is determined by the total of the dice shaken by the banker. The cards are dealt clockwise, starting with the action button position. Each position is dealt a hand of three cards, so long as there is a bet there. One may play the hand pat or one may signal that one wishes to draw a fourth card. A player may play more than one hand. One plays each hand in turn. Once a player touches the next hand, that player may not change a prior hand.

Preferably, backline betting is allowed. Only seated players may handle the cards. When a non-seated player controls a hand by having bet the most money, he or she may allow a seated player betting in the position to set it. Otherwise, the hand will be set the house way. The preferred house way rule of the present invention is to hit on 0, 1, 2, 3, 4 or 5 and to stand on 6, 7, 8 or 9.

The draw moves clockwise, starting with the first active position to the left of the banker position. The banker may not look at or even touch his or her cards. When the draw is concluded, the house dealer turns the banker's hand over.

If none of the hands meet the special-rule conditions of the embodiments discussed below, then, in each embodiment of the invention, the banker must hit on 1, 2, or 3; the banker has the option to hit or stand on 4, 5, 6, 7, and 8; and the banker must stand on 9. In order to win, a player's hand must beat the banker's hand. Ties are a push-both sides (banker and player) get back their bets.

The settlement starts with the action button position and moves clockwise. All hands will be exposed. No player may win or lose more money than was actually wagered.

In the embodiment illustrated in FIG. 1, the special-rule of this invention is as follows. When the banker's first three cards total zero (three Face Cards; a Four, a Six and a Face Card; and so on), the banker does not hit. The non-banker player wins from the banker player 100% of the non-banker player's bet with 7, 8 or 9; the player wins 50 percent of his or her bet with 6; and the player pushes with other hands (that is, he or she wins nothing but gets his or her bet back). In terms of percentages, a push (or tie) thus could be said to be a "win" of 0%.

This rule change favors the banker slightly because, with the first three cards totaling zero, the banker would otherwise lose 100% of the bet more often (given that the banker could only draw one more card to try to get closer to 9).

In FIG. 1, the banker has been dealt three Face Cards, whose total is 0, invoking the special-rule of the first embodiment. Player 1 has a total of 5 (2+3+0); therefore it is a push for player 1. Player 2 has a total of 6 (2+4+0); so player 2 wins just 50 percent of his or her bet. Player 3 has 9 (4+5+0) and is paid 100% of his or her bet by the banker. Assuming each player has bet $10, Player 1 would get his or her $10 back as a result of the push (bet "plus" 0%); Player 2 would get $15 (bet plus 50%); and Player 3 would get $20 (bet plus 100%).

Figure 2:
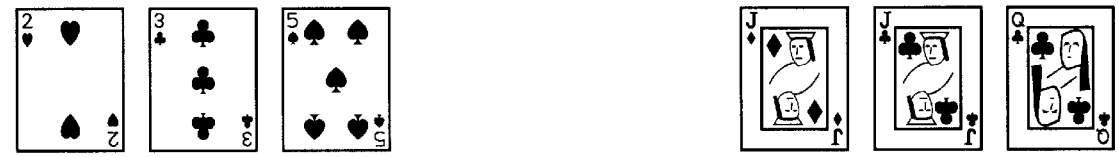
FIG. 2 is a schematic top view of a card round illustrating a second preferred embodiment of this invention.

In the embodiment illustrated in FIG. 2, the special-rule of this invention is as follows. When any player other than the banker gets all Face Cards as the first three cards (0 value), that player loses 100% of his or her bet to the banker regardless of what the banker has—again giving the banker a slight edge over prior art games. In FIG. 2, the banker has been dealt cards totaling 0 (2+3+5=10). The first three cards of player 1 are face cards, so player 1 loses 100%. Note that player 1 does not have the option of drawing another card to try to improve the hand. Also note that without the special-rule of this embodiment player 2 would have a push as the hand stands, because the total of player 2 is 0 and the total of the banker is 0 (2+3+5=10).

Figure 3:
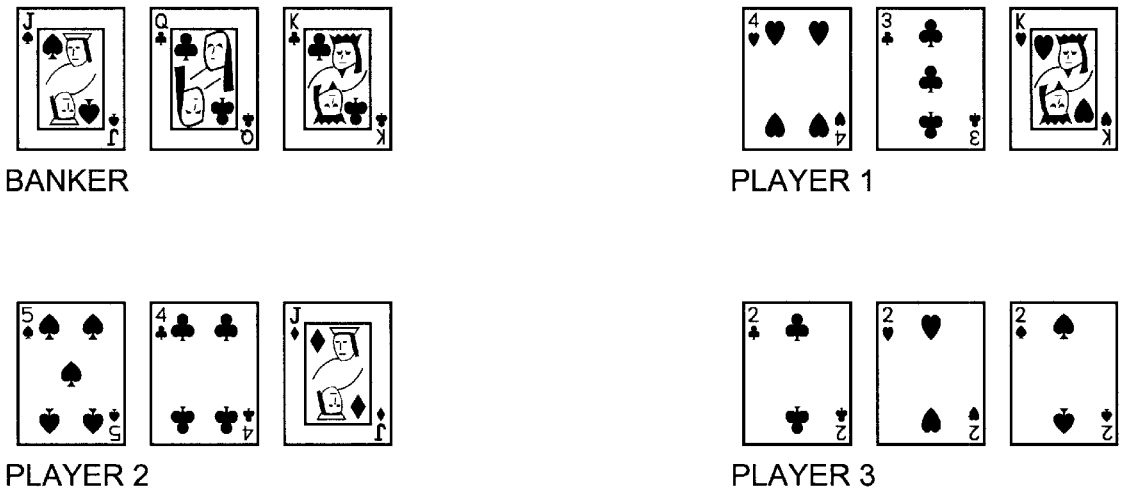
FIG. 3 is a schematic top view of a card round illustrating a third preferred embodiment of this invention.

In the embodiment illustrated in FIG. 3, the special-rule of this invention is as follows. When the banker's first three cards are Face Cards, the banker wins 50 percent of each player's bet. Since in FIG. 3 the banker's first three cards are Face Cards, the banker wins 50 percent of the bets of player 1 (showing 7), player 2 (showing 9), and player 3 (showing 6). Note that the banker wins 50 percent of the bet of player 2 even though in the example of FIG. 3 player 2 has 9 (5+4+0), which without the special rule of the embodiment of FIG. 3 would entitle player 2 to at least a push, if not a win.

Figure 4:
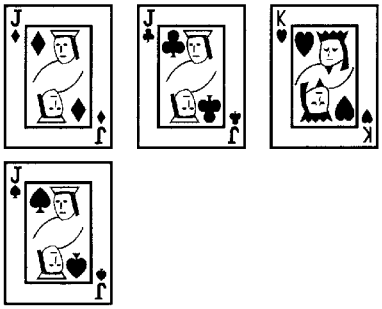
FIG. 4 is a schematic top view of a card round illustrating a fourth preferred embodiment of this invention.
Figure 4:
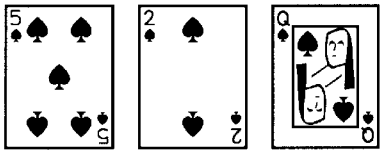
Figure 4:
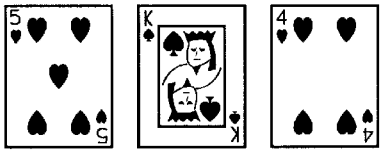

In the embodiment illustrated in FIG. 4, the special-rule of this invention is as follows. When the banker's first three cards are all Face Cards, and the banker draws a Face Card, the banker wins 100% of all bets against all players. In the example illustrated in FIG. 4, the banker's first three cards were Face Cards, to which the banker must hit in view of the rule governing the banker's draw. Having drawn a fourth Face Card, the banker wins all bets, in this case getting 100% of the bet of player 1, having 7 (5+2+0), and 100% of the bet of player 2, having 9 (5+0+4). Without the special-rule of the embodiment of FIG. 4, player 2 would have had at least a push and probably a win.

As to the manner of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventors. While there is provided herein a full and complete disclosure of the preferred embodiments of this invention, it is not desired to limit the invention to the exact construction, steps, dimensional relationships, and operation shown and described. Various modifications, alternative methods, changes and equivalents will readily occur to those skilled in the art and may be employed, as suitable, without departing from the true spirit and scope of the invention. Such changes might involve alternative cards, components, order of play, winning combinations, functions, operational features or the like. For example, other rules favoring the banker player in an equitable manner could be formulated as the special-rule for determining the payout percentage herein.

Therefore, the above description and illustrations should not be construed as limiting the scope of the invention, which is defined by the appended claims.

The invention claimed is:

1. A method of playing Super Pan 9, including the steps of:

providing a deck of playing cards, said card deck having a like number of aces, twos, threes, fours, fives, sixes, jacks, queens and kings, said jacks, queens and kings being denominated face cards;

providing a banker player and a non-banker player;

said non-banker player and said banker player placing a non-banker player's bet and a banker player's bet, respectively;

dealing from said deck a banker player's initial hand of three cards to said banker player and a non-banker player's initial hand of three cards to said non-banker player;

providing each player with the opportunity to select between drawing an additional card and standing on said player's initial hand, said selection resulting in said player's final hand;

evaluating players' hands of dealt cards according to the sum of the values of said dealt cards, modulo ten, the value of twos, threes, fours, fives and sixes being their face value, the value of aces being one, and the value of jacks, queens and kings being zero;

providing that when said banker player's initial hand evaluates to zero, said banker player must stand on said banker player's initial hand and said non-banker player wins from said banker player 100 percent of said non-banker player's bet when said non-banker player's final hand evaluates to 7, 8 or 9, said non-banker player wins from said banker player 50 percent of said non-banker player's bet when said non-banker player's final hand evaluates to 6, and said non-banker player wins from said banker player zero percent of said non-banker player's bet when said non-banker player's final hand evaluates to 5 or less; and providing that when said banker player's initial hand does not evaluate to zero, said non-banker player wins from said banker player 100 percent of said non-banker player's bet when said non-banker player's final hand evaluates to a higher number than does said banker player's final hand, said non-banker player wins from said banker player zero percent of said non-banker player's bet when said non-banker player's final hand evaluates to the same number as does said banker player's final hand, and said non-banker player loses to said banker player 100 percent of said non-banker player's bet when said non-banker player's final hand evaluates to a lower number than does said banker player's final hand.

2. The method of claim 1, further including the steps of:

providing that said banker player must draw an additional card when said banker player's initial hand evaluates to 1, 2, or 3;

providing that said banker player may select between drawing an additional card and standing on said banker player's initial hand when said banker player's initial hand evaluates to 4, 5, 6, 7, or 8; and providing that said banker player must stand on said banker player's initial hand when said banker player's initial hand evaluates to 9.

3. The method of claim 2, wherein:

there is one said banker player and there is a plurality of said non-banker players.

4. A method of playing Super Pan 9, including the steps of:

providing a deck of playing cards, said card deck having a like number of aces, twos, threes, fours, fives, sixes, jacks, queens and kings, said jacks, queens and kings being denominated face cards;

providing a banker player and a non-banker player;

said non-banker player and said banker player placing a non-banker player's bet and a banker player's bet, respectively;

dealing from said deck a banker player's initial hand of three cards to said banker player and a non-banker player's initial hand of three cards to said non-banker player;

providing each player with the opportunity to select between drawing an additional card and standing on said player's initial hand, said selection resulting in said player's final hand;

evaluating players' hands of dealt cards according to the sum of the values of said dealt cards, modulo ten, the value of twos, threes, fours, fives and sixes being their face value, the value of aces being one, and the value of jacks, queens and kings being zero;

providing that when said non-banker player's initial hand is comprised of all face cards, said non-banker player loses to said banker player 100% of said non-banker player's bet; and providing that when said non-banker player's initial hand is not comprised of all face cards, said non-banker player wins from said banker player 100 percent of said non-banker player's bet when said non-banker player's final hand evaluates to a higher number than does said banker player's final hand, said non-banker player wins from said banker player zero percent of said non-banker player's bet when said non-banker player's final hand evaluates to the same number as does said banker player's final hand, and said non-banker player loses to said banker player 100 percent of said non-banker player's bet when said non-banker player's final hand evaluates to a lower number than does said banker player's final hand.

5. The method of claim 4, wherein:

there is one said banker player and there is a plurality of said non-banker players.

6. A method of playing Super Pan 9, including the steps of:

providing a deck of playing cards, said card deck having a like number of aces, twos, threes, fours, fives, sixes, jacks, queens and kings, said jacks, queens and kings being denominated face cards;

providing a banker player and a non-banker player;

said non-banker player and said banker player placing a non-banker player's bet and a banker player's bet, respectively, dealing from said deck a banker player's initial hand of three cards to said banker player and a non-banker player's initial hand of three cards to said non-banker player;

providing each player with the opportunity to select between drawing an additional card and standing on said player's initial hand, said selection resulting in said player's final hand;

evaluating players' hands of dealt cards according to the sum of the values of said dealt cards, modulo ten, the value of twos; threes, fours, fives and sixes being their face value, the value of aces being one, and the value of jacks, queens and kings being zero;

providing that when said banker player's initial hand is comprised of all face cards, said non-banker player loses to said banker player 50 percent of said non-banker player's bet; and providing that when said banker player's initial hand is not comprised of all face cards, said non-banker player wins from said banker player 100 percent of said non-banker player's bet when said non-banker player's final hand evaluates to a higher number than does said banker player's final hand, said non-banker player wins from said banker player zero percent of said non-banker player's bet when said non-banker player's final hand evaluates to the same number as does said banker player's final hand, and said non-banker player loses to said banker player 100 percent of said non-banker player's bet when said non-banker player's final hand evaluates to a lower number than does said banker player's final hand.

7. The method of claim 6, wherein:

there is one said banker player and there is a plurality of said non-banker players.

8. A method of playing Super Pan 9, including the steps of:

providing a deck of playing cards, said card deck having a like number of aces, twos, threes, fours, fives, sixes, jacks, queens and kings, said jacks, queens.and kings being denominated face cards;

providing a banker player and a non-banker player;

said non-banker player and said banker player placing a non-banker player's bet and a banker player's bet, respectively;

dealing from said deck a banker player's initial hand of three cards to said banker player and a non-banker player's initial hand of three cards to said non-banker player;

providing each player with the opportunity to select between drawing an additional card and standing on said player's initial hand, said selection resulting in said player's final hand;

evaluating players' hands of dealt cards according to the sum of the values of said dealt cards, modulo ten, the value of twos, threes, fours, fives and sixes being their face value, the value of aces being one, and the value of jacks, queens and kings being zero;

providing that when said banker player's initial hand is comprised of all face cards and said banker player draws a face card, said non-banker player loses to said banker player 100 percent of said non-banker player's bet; and providing that when said banker player's initial hand is not comprised of all face cards, and also when said banker player's initial hand is comprised of all face cards but said banker player does not draw a face card, said non-banker player wins from said banker player 100 percent of said non-banker player's bet when said non-banker player's final hand evaluates to a higher number than does said banker player's final hand, said non-banker player wins from said banker player zero percent of said non-banker player's bet when said non-banker player's final hand evaluates to the same number as does said banker player's final hand, and said non-banker player loses to said banker player 100 percent of said non-banker player's bet when said non-banker player's final hand evaluates to a lower number than does said banker player's final hand.

9. The method of claim 8, wherein:

there is one said banker player and there is a plurality of said non-banker players.

* * * * *